United States Patent [19]

Ishii

[11] 4,414,779

[45] Nov. 15, 1983

[54] WINDOW REGULATOR FOR AN AUTOMOTIVE VEHICLE

[75] Inventor: Kinichi Ishii, Yokohama, Japan

[73] Assignee: Kabushiki Kaisha Johnan Seisakusho, Japan

[21] Appl. No.: 324,079

[22] Filed: Nov. 23, 1981

[30] Foreign Application Priority Data

Dec. 13, 1980 [JP] Japan ..... 55-176233

[51] Int. Cl.[3] ..... E05F 11/44

[52] U.S. Cl. ..... 49/351; 49/349

[58] Field of Search ..... 49/348–351, 49/353

[56] References Cited

U.S. PATENT DOCUMENTS 2,544,451 3/1951 Floraday ..... 49/351
3,231,301 1/1966 Gray ..... 49/351 X
3,888,047 6/1975 Chikaraishi ..... 49/351
3,897,652 8/1975 Hess ..... 49/351

*Primary Examiner*—Kenneth Downey
*Attorney, Agent, or Firm*—McGlew and Tuttle

[57] ABSTRACT

An X-arm type window regulator for an automotive vehicle for raising and lowering a window pane comprises a novel crank-like subarm with a stepped portion at the middle portion thereof, a main arm with a middle pivot hole, and a pair of arc-shaped, roughly semicircular pivots, in addition to the conventional elements such as a movable guide rail, a fixed guide rail, a rack and a pinion, a plurality of rollers, etc. The stepped portion of the crank-like subarm is positioned in the middle pivot hole of the main arm perpendicular to the main arm and is sandwiched by the two semicircular pivots, so that the subarm is rotatably supported on either side of the main arm to form an X-arm link mechanism.

6 Claims, 8 Drawing Figures

WINDOW REGULATOR FOR AN AUTOMOTIVE VEHICLE

BACKGROUND OF THE INVENTION

1. Field of the Invention

The present invention relates generally to an X-arm type window regulator for an automotive vehicle, and more specifically to a structure of a single subarm rotatably supported on either side of a main arm to constitute an X-arm-type window regulator for an automotive vehicle.

2. Description of the Prior Art

The background of the present invention will be explained with respect to its application to the window regulator for an automotive vehicle.

As is well known, a window regulator is used for an automotive vehicle in order to raise and lower a window pane provided for a vehicle door. The prior-art window regulator for an automotive vehicle usually uses a link mechanism and therefore includes a main arm and a pair of subarms. The two subarms are rotatably supported on either side of the main arm separately by using a special axle having a pair of square projections on either side thereof. The projections fit into square hole formed in each subarm.

In the above-mentioned structure of the prior-art window regulator, however, since the two subarms and a special axle must be used in the construction of the X-shaped arm for the window regulator, the number of required parts is relatively high and also it is relatively complicated to assemble the axle having two square projections formed on either side thereof to the respective square holes formed in the two separate subarms.

The arrangement of the prior-art window regulator for an automotive vehicle will be described in more detail hereinafter with reference to the attached drawings under DETAILED DESCRIPTION OF THE PREFERRED EMBODIMENTS

SUMMARY OF THE INVENTION

With these problems in mind, therefore, it is the primary object of the present invention to provide a novel X-arm type window regulator for an automotive vehicle which is easy to assemble and requires few moving parts.

To achieve the above-mentioned object, the window regulator for an automotive vehicle according to the present invention comprises a main arm having a middle pivot hole formed therein, a single crank-like subarm having a stepped portion connecting a first and a second subarm at the middle thereof, and a pair of arc-shaped, roughly semicircular pivots to rotatably support the crank-like subarm on either side of the main arm with the stepped portion of the subarm sandwiched between the semicircular pivots in the middle pivot hole of the main arm.

Further in this case, after the crank-like subarm has been passed through the middle pivot hole formed in the main arm, the subarm is rotatably supported on either side of the main arm by sandwiching the stepped portion of the subarm by the pair of arc-shaped, roughly semicircular pivots.

The window regulator according to the present invention can improve productivity of its manufacture and thus reduce manufacturing cost.

BRIEF DESCRIPTION OF THE DRAWINGS

The features and advantages of the window regulator according to the present invention will be more clearly appreciated from the following description taken in conjunction with the accompanying drawings in which like reference numerals designate corresponding elements in which.

DETAILED DESCRIPTION OF THE PREFERRED EMBODIMENTS

To facilitate understanding of the present invention, a brief reference will be made to a prior-art window regulator for an automotive vehicle, with reference to the attached drawings.

Figure 1:
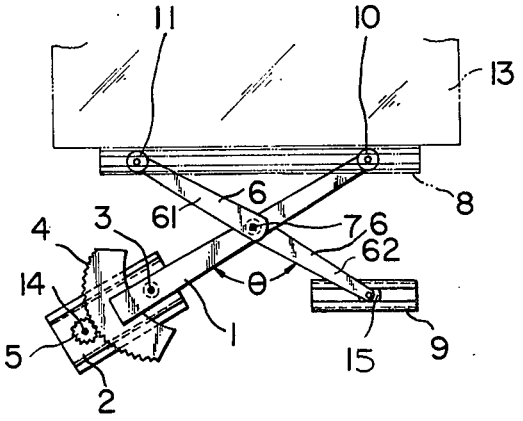
FIG. 1 PRIOR ART
FIG. 1 is a front view showing a sample prior-art window regulator for an automotive vehicle.

In FIG. 1, the reference numeral 1 denotes a main arm one end of which moves along a movable channel-shaped guide rail 8 with a roller 10 rotatably mounted on the extreme end thereof and the other end of which is rotatably supported by a pin 3 fixed to a base member 2 fixed to a vehicle door (not shown). The reference numeral 61 denotes a first subarm, one end of which moves along the movable channel-shaped guide rail 8 with another roller 11 rotatably mounted on the extreme end thereof and the other end of which is rotatably supported by an arm pin 7 fixed at the central position of the main arm 1. The reference numeral 62 denotes a second subarm, one end of which moves along a fixed channel-shaped guide rail 9 with the other roller 15 rotatably mounted on the extreme end thereof and the other end of which is rotatably supported by the arm pin 7 at the central position of the main arm 1 coaxially with the end of the first subarm 61. The reference numeral 4 denotes a fan-shaped rack fixed to the free end of the main arm 1. The rack 4 is rotated clockwise or counterclockwise by a pinion 5 rotatably supported by a pinion shaft 14 fixed to the base 2 so as to gear with the rack 4.

In the prior-art window regulator thus constructed, when the pinion 5 is rotated clockwise or counterclockwise, the main arm 1 pivots about the pin 3 due to the engagement of the rack 4 and the pinion 5. Therefore, the positions of the main arm 1 and the first and second subarms 61 and 62 are changed, thereby, changing the angle $\theta$ subtended by the main arm 1 and the subarm 62. Since the roller 15 rotatably supported at the end of the second subarm 62 moves along the fixed guide rail 9 without changing its vertical position, the movable guide rail 8 within which the rollers 10 and 11 are rotatably engaged is moved up and down, so that the window pane 13 is also moved up and down in conjunction with the up-and-down movement of the movable guide rail 8.

Figure 2:
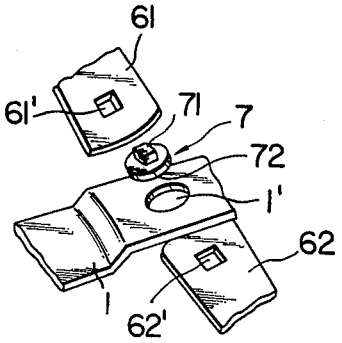
FIG. 2 PRIOR ART
FIG. 2 is a perspective view showing a sample prior-art structure to rotatably support a pair of subarms onto a main arm.

In the above-mentioned X-arm-type window regulator, when the window pane is lowered, since the rollers 10 and 11 are also lowered below the roller 15, that is, beyond the fixed rail 9, the subarms 61 and 62 must be on opposite sides of the main arm 1 in order not to interfere with the main arm 1. In order to avoid the interference of the fixed rail 9 with the window pane 13, the subarm 61 on the window glass side and the subarm 62 on the fixed rail side must be constructed so as to rotate independently with respect to the main arm 1. Therefore, conventionally, as depicted in FIG. 2, the subarm is divided into two separate parts 61 and 62, and are pivotably supported on the main arm 1 by of an axle 7 having a square pillar projection 71 or 72 on either side fitted into the respective square holes 61' and 62' formed in the base portion of the respective subarms 61 and 62, the axle being installed within an axle hole 1' formed in the main arm 1.

In the above-mentioned structure, however, since the subarm 6 must be divided into the two members 61 and 62, the number of necessary parts increases and also it is troublesome to manufacture the axle having square pillar projections on either side to the subarms 61 and 62.

In view of the above description, reference is now made to a preferred embodiment of the window regulator for an automotive vehicle according to the present invention, in which a novel single subarm is rotatably supported on either side of the main arm by a pair of arc-shaped, roughly semicircular pivots.

Figure 3:
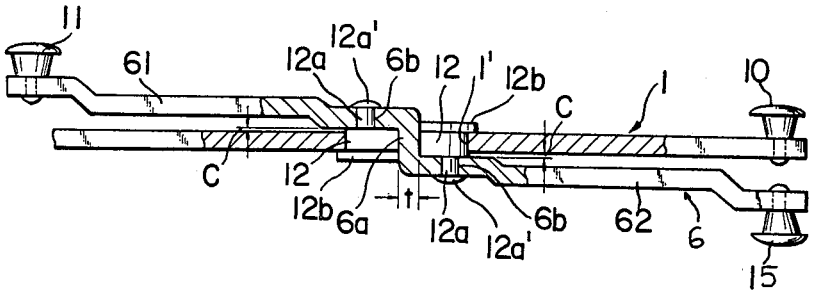
FIG. 3 is a fragmentary sectional view showing a state where the main arm and the subarm according to the present invention engage via a pair of arc-shaped semicircular pivots.
Figure 4:
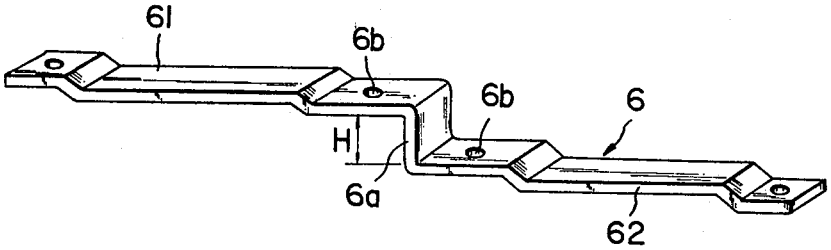
FIG. 4 is a perspective view showing the crank-like subarm according to the present invention.
Figure 5:
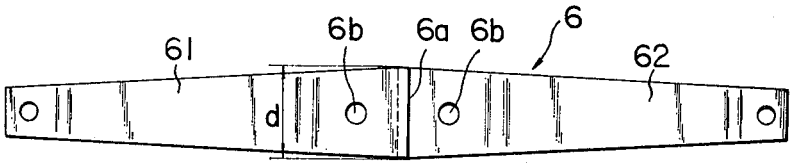
FIG. 5 is a front view showing the crank-like subarm according to the present invention.

As shown in FIGS. 3, 4, and 5, the subarm 6 is integrally formed in such a way that the two subarms 61 and 62 are connected to each other by a stepped portion 6*a*.

Figure 8:
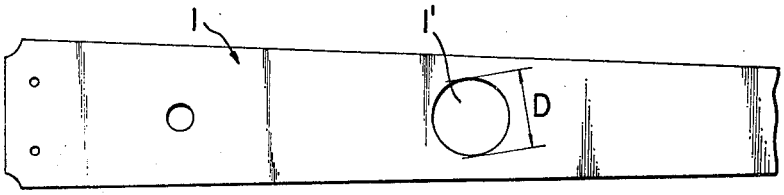
FIG. 8 is a fragmentary front view showing the main arm according to the present invention.

In the subarm 6, as depicted in FIG. 4, the stepped portion 6*a* thereof has a widest dimension d and the other portions 61 or 62 thereof have width equal to or a little smaller than d. Further in this case, the width d of the stepped portion 6*a* is a little smaller than the diameter D of an pivot-fitting hole 1' formed in the main arm 1 shown in FIG. 8.

The subarm 6 formed as explained above is inserted into the pivot hole 1' in the main arm 1, beginning from the one end of the subarm 6, until the stepped portion 6*a* of the subarm reaches the pivot hole 1' in the main arm 1. That is to say, the subarm 61 and the subarm 62 are placed on either side of the main arm 1, respectively, as depicted in FIG. 3.

Figure 6:
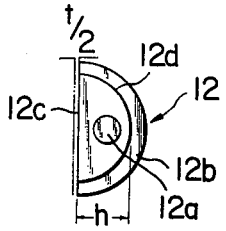
FIG. 6 is a front view showing the arc-shaped roughly semicircular pivot according to the present invention.
Figure 7:
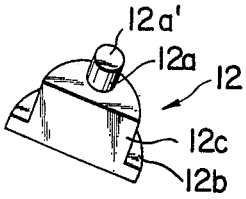
FIG. 7 is a perspective view showing the semicircular pivot according to the present invention.

Next, two arc-shaped, roughly semicircular pivots 12, each having a pivot pin 12*a* on one side surface and a flange portion 12*b* on the other side as shown in FIGS. 6 and 7 and a slidable portion 12*d* therebetween, are fitted to the pivot hole 1' in the main arm 1 with the stepped portion 6*a* of the subarm 6 sandwiched by the two cut end surfaces 12*c* of the two roughly semicircular pivots 12 and with the pivot pins 12*a* of the semicircular pivots 12 fitted to the fitting holes 6*b* formed near the center of the subarm 6 as shown in FIG. 3. Thereafter, the top ends 12*a* of the pivot pins 12 are deformed to form flanges by using an ultrasonic pressing apparatus or a spinning device to fix the pivots 12 to the respective subarms 61 and 62.

Therefore, the two pivots 12 sandwiching the stepped portion 6*a* of the subarm 6 are so combined so as to function as an axle fitted to the pivot hole 1' of the main arm 1. In this case, there must be provided a clearance c between the surface of the main arm 1 and the surface near the base portion of the subarms 61 and 62 with the main arm sandwiched between the flange portion 12*b* and the subarm 61 or 62, so that the main arm 1 and the subarm 6 can be rotatably connected by the two roughly cemicircular pivots 12.

Further, in this embodiment, since the surface 12*c* of the roughly semicircular pivot 12 is truncated from a completely semicircular surface by one half of the plate thickness t of the subarm 6 as shown in FIG. 6, in other words, since the diameter D of the middle pivot hole 1' formed at the middle portion of the main arm 1 is roughly the same as the sum total of the plate thickness of the subarm 6 and twice the radial height h of the slidable portion 12*d* of the roughly semicircular pivot, when the stepped portion 6*a* of the subarm 6 is sandwiched by the two pivots 12, the outer peripheral surface of the two pivots 12 becomes a complete, circular surface for sliding in the pivot hole 1' of the main arm 1.

Further, in this embodiment, it is desirable that the semicircular pivot 12 is made of a synthetic resin such as nylon or polyacetal which is hard and slides easily.

Further, the height H of the stepped portion 6*a* of the subarm 6 is determined by to the height of the slidable portion 12*d* of the pivot 12, which is a little larger than the thickness of the main arm 1.

As described above, in the X-arm-type window regulator, since the subarm is provided with the stepped portion formed integraly therewith and inserted into the pivot hole of the main arm with the stepped portion of the subarm placed in the central pivot hole of the main arm, and since two semicircular pivots are fitted to the pivot hole of the main arm, so as to sandwich the stepped portion of the subarm, and fixed to the subarms, it is possible to combine the subarm conventionally divided into two elements into a single element, thus resulting in reduction of the number of parts, simplification of assembly, improvement of strength in the arm assembly, and reduction of manufacturing cost.

It will be understood by those skilled in the art that the foregoing description is terms of preferred embodiments of the present invention wherein various changes and modifications may be made without departing from the spirit and scope of the invention, as is set forth in the appended claims.

What is claimed is:

1. An improved X-arm type window regulator for an automotive vehicle for raising and lowering a window pane for a vehicle door which includes:

a movable guide rail (8) attached to the lower edge of the window pane;

a fixed guide rail (9) fixed to the vehicle door;

a plurality of rollers (10, 11, 15) movable along said movable guide rail and said fixed guide rail, the improvement which comprises:

(1) a main arm (1) one end of which moves along said movable guide rail with one of said rollers rotatably attached thereto and the other end of which is pivotably supported on the vehicle door, said main arm being formed with a middle pivot hole (1') therein;

(2) a crank-like subarm (6) having a first subarm portion (61), a second subarm portion (62), and a stepped portion to connect the first and second subarm portions, one end of which moves along said movable guide rail with one of said rollers rotatably attached thereto, the other end of which moves along said fixed guide rail with one of said rollers rotatably attached thereto, and the stepped portion of which is loosely positioned in the middle pivot hole of said main arm perpendicular to the plane of the middle pivot hole of said main arm by passing one end thereof through the middle pivot hole of said main arm; and (3) a pair of arc-shaped, roughly semicircular pivots (12) to rotatably support said crank-like subarm on said main arm with the stepped portion of said subarm sandwiched therebetween in the middle pivot hole of said main arm, whereby a compact X-arm can be realized by using one main arm and only one subarm.

2. An improved X-arm type window regulator for an automotive vehicle for raising and lowering a window pane for a vehicle door as set forth in claim 1, wherein said arc-shaped roughly semicircular pivot is formed with a pivot pin (12*a*), fitable to a small pivot hole (6*b*) formed near the middle portion of said subarm in order to fix said subarm to said semicircular pivot, and a flange portion (12*b*) to rotatably support said main arm in cooperation with said subarm.

3. An improved X-arm type window regulator for an automotive vehicle for raising and lowering a window pane for a vehicle door as set forth in claim 1, wherein the diameter (D) of the middle pivot hole (1') formed at the middle portion of said main arm is greater than the width (d) of said crank-like subarm, so that said crank-like subarm can be passed through the middle pivot hole of said main arm.

4. An improved X-arm type window regulator for an automotive vehicle for raising and lowering a window pane for a vehicle door as set forth in claim 1, wherein the diameter (D) of the middle pivot hole (1') formed at the middle portion of said main arm is roughly the same as the sum total of the plate thickness (t) of said subarm and twice the radial height (h) of the portion of said roughly semicircular pivot within the middle pivot hole.

5. An improved X-arm type window regulator for an automotive vehicle for raising and lowering a window pane for a vehicle door as set forth in either claim 1 or 2, wherein said arc-shaped semicircular pivots are made of a material having a relatively small coefficient of friction and high hardness.

6. An improved X-arm type window regulator for an automotive vehicle for raising and lowering a window pane for a vehicle door as set forth in claim 5, wherein the material for said arc-shaped semicircular pivots is synthetic resin.

* * * * *